US011703904B1

(12) United States Patent
Zhang et al.

(10) Patent No.: US 11,703,904 B1
(45) Date of Patent: Jul. 18, 2023

(54) FORCE FEEDBACK APPARATUS

(71) Applicant: AAC Acousitc Technologies (Shanghai)Co., Ltd., Shanghai (CN)

(72) Inventors: Lijin Zhang, Shenzhen (CN); Bing Xie, Shenzhen (CN); Liang Jiang, Shenzhen (CN)

(73) Assignee: AAC Acoustic Technologies (Shanghai)Co., Ltd., Shanghai (CN)

( * ) Notice: Subject to any disclaimer, the term of this patent is extended or adjusted under 35 U.S.C. 154(b) by 0 days.

(21) Appl. No.: 17/743,484

(22) Filed: May 13, 2022

(30) Foreign Application Priority Data

Mar. 2, 2022 (CN) ..... 202220428995.1

(51) Int. Cl.
*G05G 5/03* (2008.04)
*G05G 5/05* (2006.01)
*G05G 1/04* (2006.01)

(52) U.S. Cl.
CPC ..... *G05G 5/03* (2013.01); *G05G 1/04* (2013.01); *G05G 5/05* (2013.01)

(58) Field of Classification Search
None
See application file for complete search history.

(56) References Cited

U.S. PATENT DOCUMENTS 4,795,296 A * 1/1989 Jau ..... G05G 1/02 414/6
9,045,219 B2 * 6/2015 Bandera ..... G05G 9/04792
2019/0350757 A1 * 11/2019 Charles ..... A61F 9/00736

FOREIGN PATENT DOCUMENTS

CN 211963064 U * 11/2020 ..... A63F 13/24

* cited by examiner

*Primary Examiner* — Vicky A Johnson
(74) *Attorney, Agent, or Firm* — W&G Law Group

(57) ABSTRACT

Provided is a force feedback apparatus, including a housing, a rotation shaft fixed to the housing, a trigger movably connected to the rotation shaft and movable relative to the housing, and a force feedback assembly. The force feedback assembly includes a driving magnet fixed to a side of the trigger toward the housing, an iron core fixed to the housing and arranged opposite to the driving magnet, and a driving coil wound around the iron core. The driving coil is energized to interact with the driving magnet to generate force feedback on the trigger. The force feedback apparatus requires no additional transmission structure and directly provides force feedback through interaction between two driving elements, thereby realizing timely force feedback on the trigger and reducing the assembly difficulty while simplifying the structure. In addition, forces in two directions can be directly generated on the trigger by changing a driving current.

7 Claims, 3 Drawing Sheets

A–A

FORCE FEEDBACK APPARATUS

TECHNICAL FIELD

The present invention relates to the field of human-computer interaction, and in particular, to a force feedback apparatus applied to human-computer interaction devices.

BACKGROUND

In recent years, with the continuous development of peripherals such as all kinds of game controlling handles, toy guns, virtual reality devices, and augmented reality devices, a haptic feedback technology has been widely used in all kinds of devices such as game controlling handles, and has achieved excellent user experience effects and market responses. However, in some game scenarios, vibration feelings alone cannot meet experience requirements. In this case, better immersion feelings can be achieved if force feedback is further provided, such as in scenarios where recoil or force is required (e.g., archery, racing, and rocket scenarios). Therefore, there is a need to design a force feedback module, which can meet requirements on vibration feedback while providing force feedback.

A force feedback apparatus in the related art is realized mainly by a motor driving a worm, a gear, and so on. Specifically, when the motor is energized, the worm rotates and then converts the force into a linear directional force through conversion of the gear, so as to push a trigger. After power is off, a torsion spring can retreat the trigger to an initial position. However, the force feedback apparatus in the related art is complicated in assembly, and there is a need to convert a rotating force into a linear directional force by the worm and the gear. The force on the trigger is in only one direction, and the forces in two directions cannot be achieved. In addition, a rotational speed of the trigger is reduced while force of the motor is amplified by a reduction gear, thereby affecting the timeliness of the force feedback and degrading user experience.

Therefore, there is a need to provide an improved force feedback apparatus to solve the above problems.

SUMMARY

Based on the above problems, the present invention provides a force feedback apparatus with simple assembly and a better force feedback performance.

Specifically, the present invention proposes a solution as follows.

Provided is a force feedback apparatus, including a housing, a rotation shaft fixed to the housing, a trigger movably connected to the rotation shaft and movable relative to the housing, and a force feedback assembly. The force feedback assembly includes a driving magnet fixed to a side of the trigger toward the housing, an iron core fixed to the housing and arranged opposite to the driving magnet, and a driving coil wound around the iron core; and the driving coil is energized to interact with the driving magnet to generate force feedback on the trigger.

In an improved embodiment, the force feedback assembly further includes a reset spring arranged between the trigger and the housing, and the reset spring has one end connected to a side of the trigger toward the housing and another end connected to a side of the housing toward the trigger.

In an improved embodiment, the force feedback assembly further includes at least one damping magnet fixed to the housing and arranged opposite to the driving magnet, the at least one damping magnet is spaced from the driving coil and arranged at a peripheral side of the driving coil, and same polars of the at least one damping magnet and the driving magnet are arranged opposite to each other.

In an improved embodiment, the at least one damping magnet is in a shape of a ring, and the at least one damping magnet is arranged around the peripheral side of the driving coil.

In an improved embodiment, each of the at least one damping magnet is in a shape of a strip, the at least one damping magnet includes two damping magnets, and the two damping magnets are spaced from the driving coil and arranged at two sides of the driving coil.

In an improved embodiment, a magnetizing direction of the driving magnet is the same as a winding direction of the driving coil.

In an improved embodiment, the housing is provided with two first fixing portions spaced from each other, each of the two first fixing portions is provided with a first fixing hole, and the rotation shaft is inserted into the first fixing hole provided at each of the two first fixing portions to be fixed to the housing.

In an improved embodiment, the trigger is provided with two second fixing portions spaced from each other, the second fixing portions are arranged between the two first fixing portions and are spaced from the two first fixing portions, each of the two second fixing portions is provided with a second fixing hole, and the rotation shaft is inserted into the second fixing hole provided at each of the two second fixing portions, such that the trigger is rotatable relative to the rotation shaft.

The force feedback apparatus according to the present invention includes a housing, a rotation shaft fixed to the housing, a trigger movably connected to the rotation shaft and movable relative to the housing, and a force feedback assembly. The force feedback assembly includes a driving magnet fixed to a side of the trigger toward the housing, an iron core fixed to the housing and arranged opposite to the driving magnet, and a driving coil wound around the iron core. The driving coil is energized to interact with the driving magnet to generate force feedback on the trigger. The force feedback apparatus according to the present invention requires no additional transmission structure and directly provides force feedback through interaction between two driving elements, thereby realizing timely force feedback on the trigger and also reducing the assembly difficulty while simplifying the structure. In addition, forces in two directions can be directly generated on the trigger by changing a driving current, thereby enriching a force feedback mode of the force feedback apparatus and effectively improving user experience.

DESCRIPTION OF EMBODIMENTS

The technical solution of the present invention is described in details below with reference to the accompanying drawings and embodiments.

Figure 1:
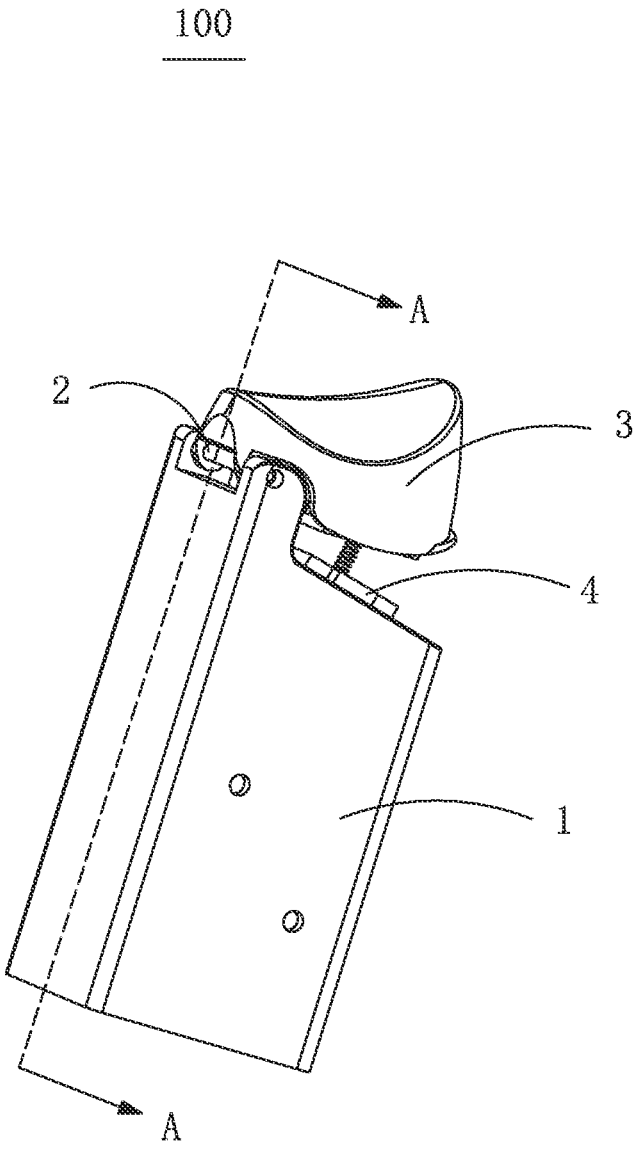
FIG. 1 is a three-dimensional view of a force feedback apparatus according to an embodiment of the present invention.
Figure 2:
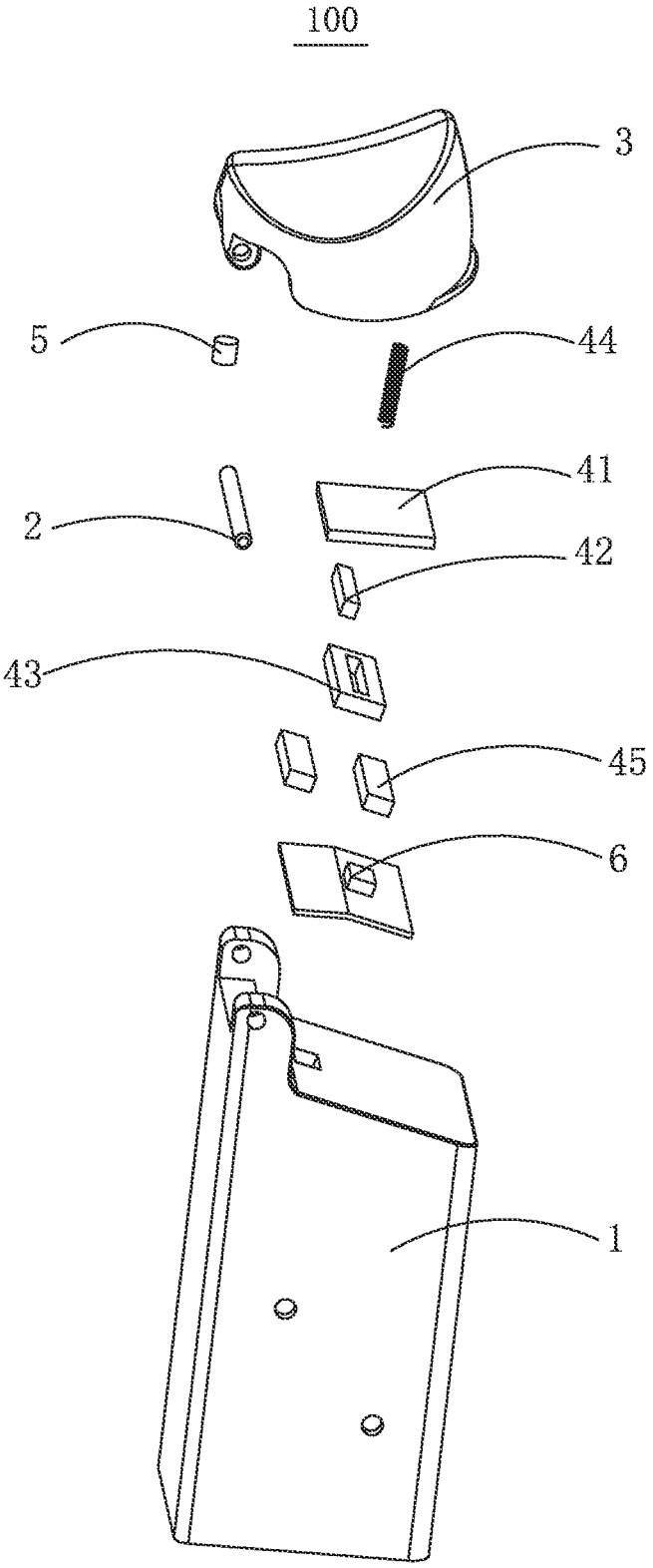
FIG. 2 is an exploded view of a force feedback apparatus according to an embodiment of the present invention.
Figure 3:
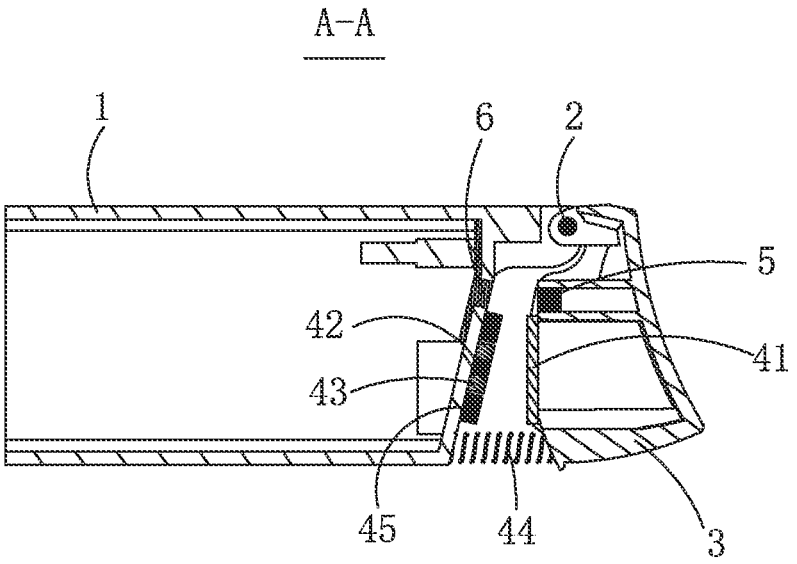
FIG. 3 is a sectional view taken along A-A shown in FIG. 1.
Figure 4:
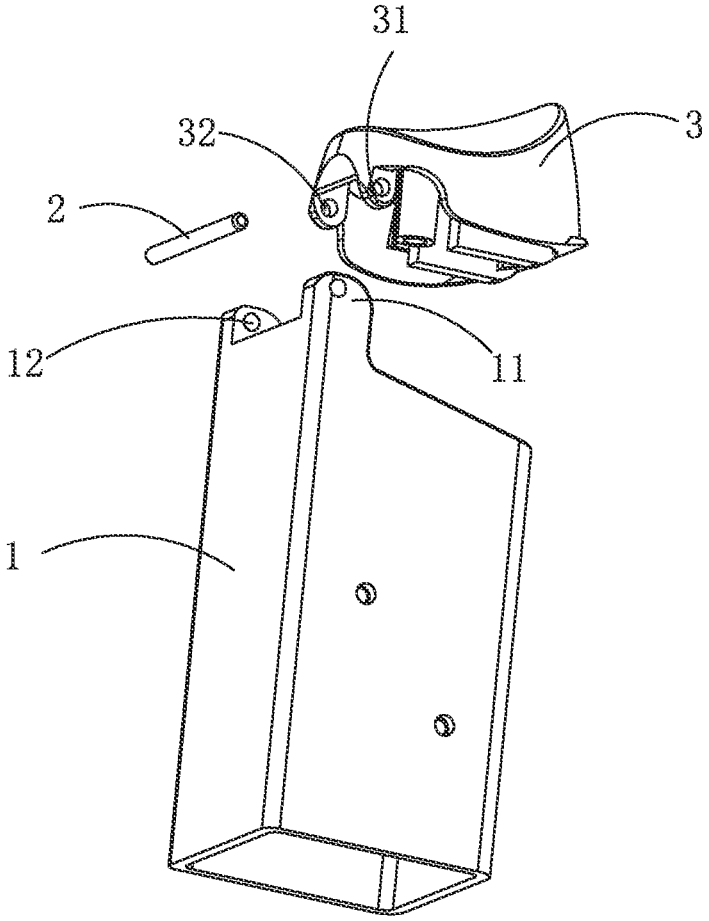
FIG. 4 is a partial three-dimensional view of a force feedback apparatus according to an embodiment of the present invention.

As shown in FIG. 1 to FIG. 4, the present invention provides a force feedback apparatus 100. The force feedback apparatus 100 includes a housing 1, a rotation shaft 2 fixed to the housing 1, a trigger 3 movably connected to the rotation shaft 2, and a force feedback assembly 4. The trigger 3 is movable relative to the housing 1. Specifically, as shown in FIG. 2 to FIG. 4, the housing 1 is provided with two first fixing portions 11 spaced from each other, each of the two first fixing portions 11 is provided with a first fixing hole 12, and the rotation shaft 2 is fixed to the first fixing portion 11 through the first fixing holes 12. In addition, the trigger 3 is provided with two second fixing portions 31 spaced from each other, each of the two second fixing portions 31 is provided with a second fixing hole 32, and the rotation shaft 2 passes through the second fixing holes 32 to allow the trigger 3 to be rotatable relative to the rotation shaft 2. In this embodiment, the second fixing portions 31 are arranged between the two first fixing portions 11 and are spaced from the two first fixing portions 11.

As shown in FIG. 2 to FIG. 3, the force feedback assembly 4 includes a driving magnet 41 fixed to a side of the trigger 3 toward the housing 1, an iron core 42 fixed to the housing 1 and arranged opposite to the driving magnet 41, and a driving coil 43 wound around the iron core 42. The driving coil 43 is energized to interact with the driving magnet 41 to generate force feedback on the trigger 3. It may be understood that a magnetizing direction of the driving magnet 41 is the same as a winding direction of the driving coil 43. The winding direction of the driving coil 43 is a thickness direction of the driving coil 43. In addition, the force feedback assembly 4 further includes a reset spring 44 arranged between the trigger 3 and the housing 1. The reset spring 44 has one end connected to a side of the trigger 3 toward the housing 1 and another end connected to a side of the housing 1 toward the trigger 3.

Further, the force feedback assembly 4 further includes at least one damping magnet 45 fixed to the housing 1 and arranged opposite to the driving magnet 41. The at least one damping magnet 45 includes at least two damping magnets 45 that are spaced from the driving coil 43 and arranged at a peripheral side of the driving coil 43. When a user presses the trigger 3, in order to prevent collision between the trigger 3 and the housing 1, same polars of the damping magnet 45 and the driving magnet 41 are arranged opposite to each other, so that the damping magnet 45 always produces a repulsive force on the driving magnet 41 on the trigger 3. When the trigger 3 is close to or even about to collide with the housing 1, the repulsive force of the damping magnet 45 on the driving magnet 41 is enhanced, so as to prevent the contact of the trigger 3 with the housing 1, thereby reducing a risk of damaging the force feedback apparatus 100 and ensuring good user experience. In addition, since the iron core 42 is made of a magnetically conductive material, when the force feedback apparatus 100 is in a non-operating state, the driving magnet 41 and the iron core 42 may attract each other. With the arrangement of the damping magnet 45, the trigger 3 may be maintained in a balanced state when not in operation. In this embodiment, each of the at least one damping magnet 45 is in a shape of a strip, the at least one damping magnet 45 includes two damping magnets 45, and the two damping magnets 45 are spaced from the driving coil 43 and arranged at two sides of the driving coil 43. In other embodiments, the at least one damping magnet 45 may also be in a shape of a ring, and in this case, the at least one damping magnet 45 is arranged around the peripheral side of the driving coil 43.

The force feedback apparatus 100 according to the present invention is further provided with a sensing permanent magnet 5 fixed to the trigger 3 and a hall sensor 6 fixed to the housing 1. The hall sensor 6 is arranged corresponding to the sensing permanent magnet 5 to sense displacement of the sensing permanent magnet 5. An operating principle of the force feedback apparatus 100 is briefly described below.

When the user presses the trigger 3, the trigger 3 undergoes a force and then may rotate relative to the rotation shaft 2, and the sensing permanent magnet 5 on the trigger 3 may change its position. Moreover, due to relative displacement between the trigger 3 and the housing 1, the hall sensor 6 can read position information of the trigger 3 by monitoring position information of the sensing permanent magnet 5, so as to input electrical signals, which generate force feedback, to the driving coil 43.

After the driving coil 43 is energized, the iron core 42 is polarized, thereby producing an electromagnetic force on the driving magnet 41. When a direction of the electromagnetic force is opposite to a moving direction of the trigger 3, the trigger 3 is pushed. When the direction of the electromagnetic force is the same as the moving direction of the trigger 3, the trigger 3 is pulled. In addition, an energization direction of the driving coil 43 may also be constantly changed to change the direction of the electromagnetic force on the driving magnet 41 to give a continuously changing force feedback effect to the trigger 3. A specific force feedback mode may be set as required. As can be seen, in the force feedback apparatus 100 according to the present invention, forces in two directions, i.e., a force to pull the trigger 3 or push the trigger 3, can be applied to the trigger 3 by changing the energization direction of the driving coil 43. After the driving coil 43 is powered off, the reset spring 44 can bring the trigger 3 back to an initial position, thereby resetting the trigger 3.

The force feedback apparatus according to the present invention includes a housing, a rotation shaft fixed to the housing, a trigger movably connected to the rotation shaft and movable relative to the housing, and a force feedback assembly. The force feedback assembly includes a driving magnet fixed to a side of the trigger toward the housing, an iron core fixed to the housing and arranged opposite to the driving magnet, and a driving coil wound around the iron core. The driving coil is energized to interact with the driving magnet to generate force feedback on the trigger. The force feedback apparatus according to the present invention requires no additional transmission structure and directly provides force feedback through interaction between two driving elements, thereby realizing timely force feedback on the trigger and also reducing the assembly difficulty while simplifying the structure. In addition, forces in two directions can be directly generated on the trigger by changing a driving current, thereby enriching a force feedback mode of the force feedback apparatus and effectively improving user experience.

The above are merely some embodiments of the present invention. It should be pointed out that those of ordinary skill in the art can make improvements without deviating from the creative concept of the present invention, but all of these shall fall within a scope of the present invention.

What is claimed is:

1. A force feedback apparatus, comprising a housing, a rotation shaft fixed to the housing, a trigger movably connected to the rotation shaft and movable relative to the housing, and a force feedback assembly, wherein the force feedback assembly comprises a driving magnet fixed to a side of the trigger toward the housing, an iron core fixed to the housing and arranged opposite to the driving magnet, and a driving coil wound around the iron core; and the driving coil is energized to interact with the driving magnet to generate force feedback on the trigger;

the force feedback assembly further comprises a reset spring arranged between the trigger and the housing, and the reset spring has one end connected to a side of the trigger toward the housing and another end connected to a side of the housing toward the trigger.

2. The force feedback apparatus as described in claim 1, wherein the force feedback assembly further comprises at least one damping magnet fixed to the housing and arranged opposite to the driving magnet, the at least one damping magnet is spaced from the driving coil and arranged at a peripheral side of the driving coil, and same polars of the at least one damping magnet and the driving magnet are arranged opposite to each other.

3. The force feedback apparatus as described in claim 2, wherein the at least one damping magnet is in a shape of a ring, and the at least one damping magnet is arranged around the peripheral side of the driving coil.

4. The force feedback apparatus as described in claim 2, wherein each of the at least one damping magnet is in a shape of a strip, the at least one damping magnet comprises two damping magnets, and the two damping magnets are spaced from the driving coil and arranged at two sides of the driving coil.

5. The force feedback apparatus as described in claim 2, wherein a magnetizing direction of the driving magnet is the same as a winding direction of the driving coil.

6. The force feedback apparatus as described in claim 1, wherein the housing is provided with two first fixing portions spaced from each other, each of the two first fixing portions is provided with a first fixing hole, and the rotation shaft is inserted into the first fixing hole provided at each of the two first fixing portions to be fixed to the housing.

7. The force feedback apparatus as described in claim 6, wherein the trigger is provided with two second fixing portions spaced from each other, the second fixing portions are arranged between the two first fixing portions and are spaced from the two first fixing portions, each of the two second fixing portions is provided with a second fixing hole, and the rotation shaft is inserted into the second fixing hole provided at each of the two second fixing portions, such that the trigger is rotatable relative to the rotation shaft.

* * * * *